United States Patent [19]

Barkan et al.

[11] 4,192,981

[45] Mar. 11, 1980

[54] STRUCTURALLY IMPROVED ROD ARRAY VACUUM INTERRUPTER

[75] Inventors: Philip Barkan, Media; Imdad Imam, Secane, both of Pa.

[73] Assignee: Electric Power Research Institute, Inc., Palo Alto, Calif.

[21] Appl. No.: 848,512

[22] Filed: Nov. 4, 1977

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,997,748 | 12/1976 | Harris | 200/144 B |
| 4,128,748 | 12/1978 | Lafferty | 200/144 B |

*Primary Examiner*—Robert S. Macon

*Attorney, Agent, or Firm*—Flehr, Hohbach, Test, Albritton & Herbert

[57] ABSTRACT

A high current interrupter is enclosed in a sealed enclosure having a pair of axially disposed contacts therein, one stationary and one movable relative thereto. An array of rods or electrodes is mounted near each end of the enclosure, the rods extending toward the opposite end of the enclosure and terminating at a free end short of the opposite end. The arrays are similar in pattern and thus each rod lies between and is spaced from rods extending from the opposite enclosure end. Each array of rods is mounted in a pair of thin spaced mounting plates, which are connected together near the centers thereof. The plates engage the rods near the end opposite the free end, both plates being electrically conductive and being connected electrically to one of the two electrical contacts within the enclosure.

6 Claims, 5 Drawing Figures

OLD ART

STRUCTURALLY IMPROVED ROD ARRAY VACUUM INTERRUPTER

BACKGROUND OF THE INVENTION

This invention relates to vacuum interrupters containing rod array structure, and more particularly to such interrupters for use in power circuits carrying high current levels. In the case of vacuum interrupters utilizing rod array structure in high power high current circuits, the rods carry the high current during arcing. This results in magnetic forces on the rods which tend to bend them radially inward. For current ratings of 80KA rms, these magnetic forces commonly reach a level close to 500 pounds necessitating considerable built-in mechanical strength in the structure of the interrupter to prevent mechanical failure. Massive structural parts will produce the desired strength, but light and compact construction is desirable due to installation requirements, as well as to facilitate transport of the interrupters to sites of ultimate use.

A high current vacuum interrupter is needed which is compact, light in weight, and yet structurally capable of passing high current levels.

SUMMARY AND OBJECTS OF THE INVENTION

In general, the disclosed rod array interrupter includes a pair of electrical contacts, one movable, relative to the other, both of which are enclosed in a sealed chamber. A pair of thin spaced rod mounting plates are connected electrically to one of the pair of contacts and positioned near one end of the sealed chamber. Another pair of this spaced rod mounting plates are connected electrically to the other of the pair of contacts and disposed toward the opposite end of the sealed chamber. A pattern of conductive rods is mounted in each of the two pairs of thin spaced rod mounting plates, with the free rod ends extending towards the opposite ends of the sealed chamber and stopping short thereof. The thin spaced rod mounting plates hold the rods in position against radial force applied thereagainst and distribute reaction force within the plates as essentially pure tensile or compressive stress. Consequently, the conductive rods lie in side by side position with opposite extending rods. As a result, a path for high levels of current exists in parallel with the contacts. The path is through one pair of thin conductive rod mounting plates connected to one contact, the conductive rods mounted in the plates, the gap between opposite extending rods, the opposing rods, and the other set of rod mounting plates.

It is an object of the present invention to provide a high current rod array vacuum interrupter which is light weight and structurally strong.

Another object of the present invention is to provide a high current rod array vacuum interrupter which is compact to facilitate installation where space is at a premium.

Another object of the present invention is to provide a high current rod array vacuum interrupter which is relatively immune to damage during shipment.

Additional objects and features of the invention will appear from the following description in which the preferred embodiment has been set forth in detail in conjunction with the accompanying drawings.

DESCRIPTION OF THE PREFERRED EMBODIMENT

Figure 1:
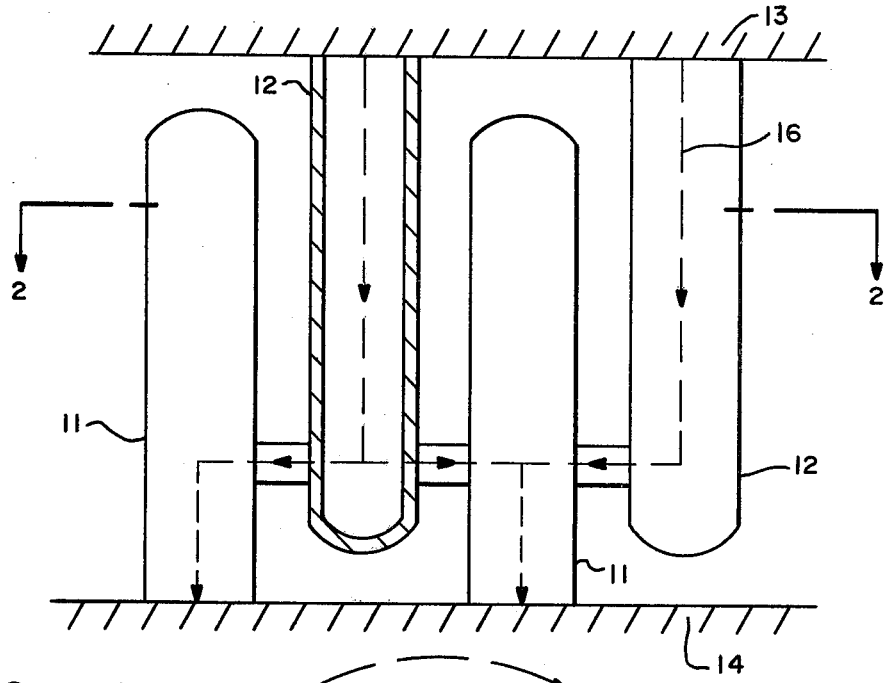
FIG. 1 is a diagramatic representation of relative positioning of the arrays of rods or electrodes.

FIG. 1 portrays part of an array of rods or electrodes 11 and 12 which are enclosed in a high current interrupter for use in a high power circuit. Rods 12 are attached to a rod mounting plate 13, and rods 11 are attached to another rod mounting plate 14. One of the rods 12 is shown in section to demonstrate that rods 11 and 12 may be of hollow construction if so desired. The hollow construction considerably reduces the total weight of the vacuum interrupter, since the rods are generally on the order of 10 inches in length, 1 to 2 inches in diameter, and are fabricated from an electrically conductive metal material.

A typical high level current path 16 is shown in FIG. 1. A sufficiently high potential at mounting plate 13 relative to mounting plate 14 produces current path 16 which transits electrodes 12, the gap between electrodes 11 and 12, the root of electrodes 11 then passes into the mounting plate 14. Note that if there are N rods 12 in the array, each rod 12 carries the maximum current level divided by N. Note also that current path 16 terminates at or near the tip of rods 12 enroute to rods 11. The location of current path 16 is presumed to be as shown in FIG. 1 to provide a worst case situation for computing forces at the free end or tip of the rods 12.

Figure 2:
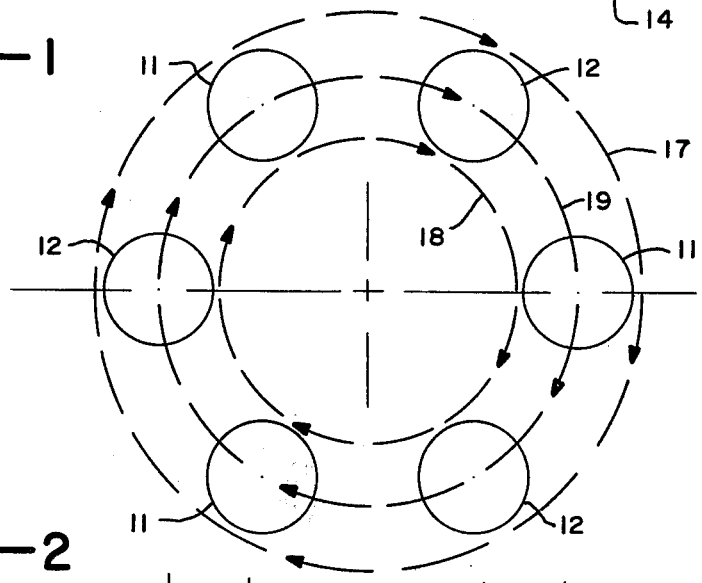
FIG. 2 is a view along the line 2—2 of FIG. 1.

Turning to FIG. 2, rods 11 and 12 are shown in two circular arrays having a mean diameter D wherein each of the rods 12 are carrying the maximum current $I_m$ divided by N, in this case three. The mean flux B acting on the rods is then:

$$B \simeq \frac{1}{2}\mu\frac{Im}{\pi D}; \qquad \text{(A)}$$

where $\mu$ is the permeability of space, $4\times10^{-7}$ in MKS units.

The magnetic flux is shown in FIG. 2 having a maximum density at an outermost flux path 17 reducing to zero density at an innermost flux path 18. The path of the mean flux density is shown at 19.

To be conservative, and to thereby account for variations to current distribution in the gap between rods 11 and 12, it is assumed, as mentioned above, that current in a rod of one polarity all leaves from the tip of each rod of such polarity. This is a highly unlikely event, since in the rod array interrupter nearly all arc discharge phenomena are diffuse. This assumption creates a situation which is estimated to be four times as severe as the practical situation. This factor of four is considered to be adequate to cover any uncertainty due to variations in relative current magnitude carried by each rod.

The magnetic force F acting on any rod 12 for the current shown flowing in path 16 of FIG. 1 is:

$$F = B\frac{Im}{N}L = \frac{1}{2}\ \frac{\mu}{\pi}\ \frac{Im^2L}{N} \qquad \text{(B)}$$

The maximum bending moment M to which each rod 12 is subjected due to the magnetic force is then:

$$M = FL = \frac{1}{2}\ \frac{\mu}{\pi D}\ \frac{I^2mL^2}{N} \qquad \text{(C)}$$

Assuming the rods 11 and 12 are hollow, having an outer diameter $d_0$ and an inner diameter $d_i$, the bending stress $\sigma$ produced in the rods 11 and 12 by the above moment is:

$$\sigma = \frac{MC}{I} = \frac{Md_o32}{(d_o4 - d_i4)\pi} \qquad \text{(D)}$$

The resulting deflection $\delta$ at the tip of the rods 12 is:

$$\delta = \frac{FL^3}{3EI} = \frac{64}{3\pi E}\ \frac{FL^3}{(d_o4 - d_i4)} \qquad \text{(E)}$$

Capital letter F is defined in Equation (B) above, and capital letter I is the moment of inertia of a section through the hollow rods 11 and 12.

The highest transient level of fault current is about 2.7 times the RMS value of the fault current. It is quite unlikely that any peak arcing current corresponding to the highest transient level will ever be experienced at an interrupter operating in a high power circuit. Allowing time for circuit fault current sensors to operate, it is estimated that a standard circuit reactance to resistance ratio of approximately 16 would provide a peak arcing current of about three-quarters of the maximum fault current. As a consequence, only about one-half of the maximum force F is developed at the current peak, since F is a function of $I_m^2$. Ignoring this benefit, and considering the severity factor of four imposed on the rod design mentioned above, it is apparent that there now exists an approximate factor of eight in over design to offset any unknown or unpredictable characteristics which may place greater loads on the rod array construction than expected.

The following Table I shows some representative results of calculations made using certain rod dimensions, and based upon the foregoing relationships.

TABLE I

L = 10 in. E = $3 \times 10^7$ psi (steel) Density = 0.28 Lb./In.$^3$
N = 5 rods $I_m$ = 216,000 amps (80 kA rms)
D — 10 inches Maximum force/rod; F = 500 lbs.

| Rod Wgt. Lb. | Rod Outside Diameter (inches) $d_o$ | Rod Inside Diameter inch $d_i$ | Cross Sectional Area (inch)$^2$ A | Peak Bending Stress Lb./In$^2$ max. | Static Rod Deflection Inch max. | Maximum Electromagnetic Force, per Rod, Lb. |
|---|---|---|---|---|---|---|
| 4.20 | 1.380 | 0 | 1.50 | 19,300 | .032 | 500 lbs. |
| 2.32 | 1.500 | 1.095 | 0.83 | 20,690 | .032 | 500 |
| 1.46 | 1.750 | 1.550 | 0.52 | 24,571 | .032 | 500 |
| 1.06 | 2.000 | 1.875 | 0.38 | 26,000 | .032 | 500 |
| 5.90 | 1.641 | 0 | 2.11 | 11,523 | .016 | 500 |
| 3.50 | 1.750 | 1.208 | 1.26 | 12,288 | .016 | 500 |
| 2.30 | 2.000 | 1.720 | 0.82 | 14,044 | .016 | 500 |
| 1.71 | 2.250 | 2.070 | 0.61 | 15,799 | .016 | 500 |

From the above results it may be seen that considerable savings in weight and materials are possible by using hollow rods 11 and 12. The force F produced by the electromagnetic interaction exceeds the weight of the heaviest rod configuration by two orders of magnitude (approximately 500:5). This leads to the belief that gravitational and shock loads introduced during horizontal operation and shipping respectively will pose no difficulty for a device which is designed to withstand the severe force imposed by electromagnetic effect.

Figure 3:
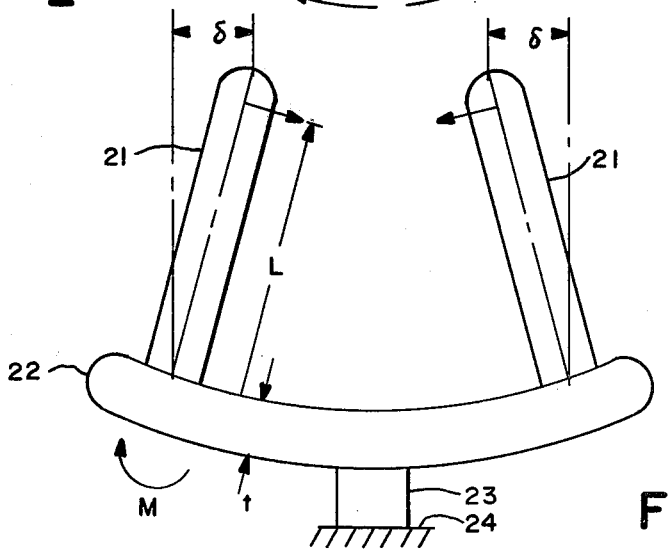
FIG. 3 is a diagramatic representation of deformation in an old art device.

Turning now to FIG. 3, a representative pair of electrodes or rods 21 of solid construction are shown mounted on a rod support plate 22. The rod support plate 22 is in turn shown mounted by means of a pedestal 23 to a support structure 24. For the very stiff rods 21 having a rod length L subjected to an inwardly directed radial electromagnetic force F, rod support plate 22 will bend as shown in exaggerated form in FIG. 3 to allow deflection at the tip or free ends of rods 21 in accordance with the relationship:

$$\delta = \frac{1.4FL^3}{Et^3} \qquad \text{(F)}$$

In the foregoing equation E represents the modulous of elasticity of the material in rod supporting plate 22, and t represents the thickness of plate 22. FIG. 3 shows an old art construction for the purpose of demonstrating the bending mode in rod support plate 22 which the invention disclosed herein is designed to correct for purposes to be hereinafter disclosed. It may be seen in FIG. 3 that the deflection $\delta$ at the tips of rods 21 is allowed purely by the bending of rod support plate 22 when rods 21 are sufficiently stiff to resist any bending moments themselves.

It has been settled that the radial deflection of the free ends of rods 11 and 12 as a result of bending in the rod support plate 14 or 13 respectively must be small compared to the normal gap between rods 11 and 12. This is taken to mean that the deflection at the free ends of the rods must be much less than one-tenth of the gap distance between rods 11 and 12. The bending stress in the rod support plates 13 and 14 due to the moments imposed as seen in equation (C) are found as to a first approximation to be:

$$\sigma \simeq \frac{1.5M}{dt^2} = \frac{1.5FL}{dt^2} \qquad \text{(G)}$$

In order that the force F induced by electro-magnetic effect and transmitted to the end plate by rods 11 and 12 impose only tolerable bending stresses in rod support plates 14 and 13, the bending stress must be less than the yield stress of the plate. For the typical examples of Table I above, and a yield stress in excess of 35,000 pounds per square inch, equation (G) above suggests that the thickness of mounting plates 13 and 14 would have to approach one inch to satisfy the stress requirement. It is realized that this thickness is perhaps greater than absolutely necessary, in view of the aforementioned cumulative safety factor of eight covering operating unknowns.

Figure 4:
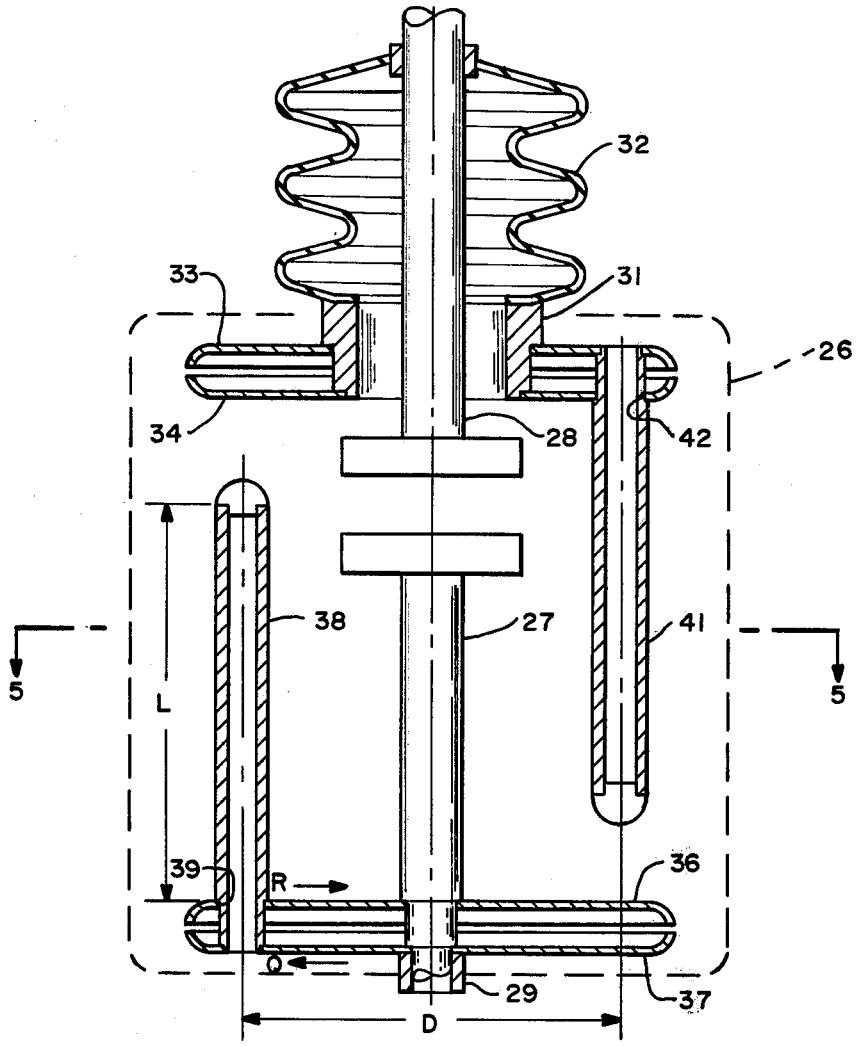
FIG. 4 is a side sectional view of the disclosed high current rod array vacuum interrupter structure.

In FIG. 4 of the drawings a high current rod array interrupter is shown having a sealed enclosure 26, on the axis of which are disposed two high power electrical contacts, a stationary contact 27 and a movable contact 28. A collar 29 surrounds stationary contact 27 where it exits sealed enclosure 26. Another collar 31 surrounds movable contact 28 which moves therethrough at the end of sealed enclosure 26 through which movable contact 28 exits. Structure such as bellows 32 is attached to collar 31 at one end and to movable contact 28 at the other, thereby allowing motion of movable contact 28 relative to sealed enclosure 26 without seal compromise.

A pair of spaced thin rod mounting plates 33 and 34 have centrally located apertures through which collar 31 extends. Thin spaced mounting plates 33 and 34 are attached to collar 31 in fixed position near one end of sealed enclosure 26. It should be noted that the peripheries of spaced rod mounting plates 33 and 34 are not in contact. Thin spaced rod mounting plates 33 and 34 are electrically connected to movable contact 28.

Another pair of thin spaced rod mounting plates 36 and 37 are disposed near the opposite end of sealed enclosure 26 engaging stationary contact 27 in fixed position thereon, and in electrical connection therewith. The configuration of the pair of thin spaced rod mounting plates 36 and 37 is similar to the configuration of thin spaced mounting plates 33 and 34. A number of rods or electrodes 38 are engaged at one end by thin mounting plates 37. A number of apertures 39 are formed in thin mounting plate 36 through which rods or electrodes 38 extend toward the other end of sealed enclosure 26 through a length L. Inwardly directed radial force F is shown at the tip or free end of rod 38.

Figure 5:
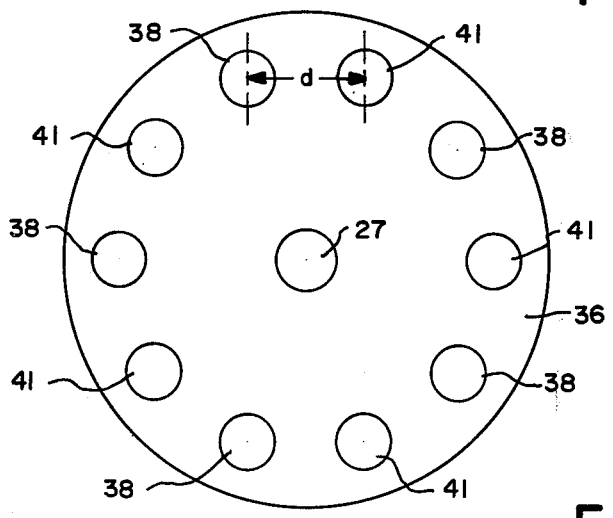
FIG. 5 is a sectional view along the line 5—5 of FIG. 4.

In similar fashion a rod 41 is engaged at one end by thin mounting plate 33. Thin mounting plate 34 has a plurality of holes 42 therethrough, through which rods 41 extend toward the end of sealed enclosure 26 housing the pair of thin spaced rod mounting plates 36 and 37, but terminating short thereof. Only one rod 38 and one rod 41 are shown in FIG. 4 for clarity, but reference to FIG. 5 will show that a plurality of rods 38 and 41 are arrayed in thin mounting plate apirs 36/37 and 33/34 respectively. Rods or electrodes 38 and 41 are positioned in their respective mounting plate assemblies which are angularly oriented so that each rod lies between and adjacent to oppositely extending rods of opposite polarity, when coupled into a high power circuit. It may also be seen from FIG. 5 that each array of rods 38 and 41 has five rods in number N disposed on a diameter D, and that the distance between adjacent rods 38 and 41 is seen as d in FIG. 5.

Considerable benefit in strength to weight ratio is obtained through the use of the relatively thin two plate structure 33/34 and 36/37 for rod mounting plates as opposed to the unitary structure of plate 22 in FIG. 3. Plates 33 and 34 are separated by a distance S on the order of 1/10th of the length L of rods 38 and 41. Such a structure virtually eliminates the bending deformation in the composite rod mounting plates 33/34 and 36/37 if rods 38 and 41 are sufficiently stiff. The stress loading in plates 33/34 and 36/37 is essentially purely tension or compression resulting from reaction forces which are essentially purely in a radial direction.

The following discusses the loading in thin spaced rod mounting plates 36 and 37, which applies to mounting plates 33 and 34 also. Due to the loading of rod 38 by force F, radial reaction forces R and Q are imparted to spaced rod mounting plates 36 and 37 respectively having the sense shown by the associated arrows in FIG. 4. Force R in thin rod mounting plate 36 may be expressed approximately as:

$$R = F(1 + \frac{L}{S}) \tag{H}$$

Force Q in thin rod mounting plate 37 may be expressed approximately as:

$$Q = F\frac{L}{S} \tag{J}$$

Consequently, thin mounting plate 36 is subjected to compressive stress and must be structurally capable of resisting buckling, while thin mounting plate 37 is subjected to tensile stress, and must be structurally capable of resisting separation.

A conservative expression for critical stress below which buckling will not occur is:

$$\sigma_{crit} = 3E\left(\frac{t}{\pi D/N}\right)^2 \tag{K}$$

For stainless steel plates having a thickness of 0.2 inches and using the necessary dimensions associated with Table I above, the critical buckling stress is computed as $9\times10^4$ pounds per square inch. A conservative estimation of the radial compression stress is given by the relationship:

$$\sigma \simeq \frac{R}{td} = \frac{F}{td}\left(1 + \frac{L}{S}\right) \tag{L}$$

This may be seen to be the force R applied to an area of thickness t and width d, the diameter of rod 38. Solution of the foregoing relationship using the parameters recited in Table II on a 0.2 inch thick plate, reveals an approximate stress of $1.8\times10^4$ pounds per square inch. This may be seen to meet the buckling criterion. Consequently, two plates 0.2 inches thick and separated by a distance of one inch constitutes an effective support structure even against the very severe loading estimates considered herein. Tensile stress capabilities in thin rod mounting plate 37 is clearly adequate if a 0.2 inch thickness is used there also.

A high current vacuum rod array interrupter has been disclosed utilizing a design which reduces weight and cost, improves performance, and poses no significant fabrication problems. Moreover, such a rod array vacuum interrupter has no orientation restrictions, since structural design accommodating electro-magnetic induced forces provides structural strength far exceeding that necessary to withstand practical shock and gravitationally induced forces.

What is claimed is:

1. A high current rod array interrupter, comprising
a sealed enclosure having opposite ends,
a first pair of thin spaced rod mounting plates disposed toward one end of said sealed enclosure,
a second pair of thin spaced rod mounting plates disposed toward the other end of said sealed enclosure,
a stationary contact extending through said one end in electrical contact with said first pair of mounting plates,
a moving contact sealably extending through said other end in electrical contact with said second pair of mounting plates and movable between position in contact with and remote from said stationary contact,
a plurality of elongate rods mounted in each of said first and second pairs of thin spaced mounting plates extending toward the opposite end of said sealed enclosure therefrom,
said first and second pairs of plates being spaced sufficiently so that lateral force exerted at the free end of said rods produces substantially only compressive and tensile stress in said thin plates.

2. A high current rod array interrupter as in claim 1 wherein said elongate rods are hollow, said rods having a wall thickness restricting rod deflection at the rod tip to a dimension substantially preventing bending stress in said pairs of thin mounting plates and reducing interrupter weight.

3. A high current rod array interrupter as in claim 2 wherein said rod deflection is limited to less than 10% of the distance between adjacent oppositely extending rods.

4. A light weight high current interrupter having a pair of contacts movable relative to one another in a sealed chamber, comprising
a first pair of thin spaced rod mounting plates connected electrically with one of the pair of contacts,
a second pair of thin spaced rod mounting plates connected electrically with the other of the pair of contacts,
a plurality of conductive rods mounted in said first and second pairs of thin spaced plates having free ends extending toward the second and first pairs of thin spaced plates respectively and lying in side-by-side position therebetween,
whereby lateral force at said free ends produces substantially only radial reaction force in said pairs of thin spaced plates.

5. A light weight high current interrupter as in claim 4 wherein said plurality of rods are hollow having a wall thickness restricting deflection at said free ends to less than ten percent of the distance to an adjacent rod.

6. Mounting apparatus for an array of spaced rods of predetermined length in a high current interrupter, comprising
a first thin plate engaging one end of each of the spaced rods,
a second thin plate, said second thin plate having a plurality of apertures therethrough each engaging the periphery of one of the rods at a position spaced from said one end,
said position spaced from said one end being greater than a predetermined fraction of the predetermined rod length,
and means connecting said first and second thin plates together toward the centers thereof,
whereby lateral force applied to the rods produces substantially tensile and compressive stresses only in said first and second thin plates.

* * * * *